US006398338B1

(12) United States Patent
Berg et al.

(10) Patent No.: US 6,398,338 B1
(45) Date of Patent: Jun. 4, 2002

(54) CAM-ACTUATED LEVER CAPPING ARM

(75) Inventors: Richard H. Berg; Paul F. Sawicki; Arthur J. Sobon, all of Rochester, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/594,693

(22) Filed: Jun. 16, 2000

(51) Int. Cl.[7] ..... B41J 2/165
(52) U.S. Cl. ..... 347/32
(58) Field of Search ..... 347/22, 23, 24, 347/29, 30, 31, 32, 33; B41J 2/165

(56) References Cited

U.S. PATENT DOCUMENTS

| | | | | | |
|---|---|---|---|---|---|
| 4,734,718 | A | * | 3/1988 | Iwagami et al. | 347/28 |
| 4,746,938 | A | | 5/1988 | Yamamori et al. | 347/28 |
| 4,806,955 | A | * | 2/1989 | Koto et al. | 347/30 |
| 4,853,717 | A | | 8/1989 | Harmon et al. | 347/29 |
| 4,855,764 | A | | 8/1989 | Humbs et al. | 347/31 |
| 5,151,715 | A | | 9/1992 | Ward et al. | 347/33 |
| 5,250,962 | A | | 10/1993 | Fisher et al. | 347/32 |
| 5,339,102 | A | * | 8/1994 | Carlotta | 347/32 |
| 5,500,659 | A | | 3/1996 | Curran, Jr. et al. | 347/28 |
| 5,548,310 | A | | 8/1996 | Binnert et al. | 347/33 |
| 5,659,341 | A | | 8/1997 | Kinas | 347/33 |
| 5,943,071 | A | | 8/1999 | Premnath | 347/33 |
| 6,130,684 | A | | 10/2000 | Premnath et al. | 347/30 |
| 6,139,129 | A | * | 10/2000 | Tabasso et al. | 347/33 |

FOREIGN PATENT DOCUMENTS

| | | | | |
|---|---|---|---|---|
| JP | 5-177842 A | * | 7/1993 | B41J/2/165 |
| JP | 5-318753 A | * | 12/1993 | B41J/2/165 |

* cited by examiner

*Primary Examiner*—John Barlow
*Assistant Examiner*—Blaise Mouttet
(74) *Attorney, Agent, or Firm*—Oliff & Berridge, PLC

(57) ABSTRACT

A method and system for a cam-actuated lever capping arm for use in a maintenance station of an ink jet printer, the printer including a bi-directional translatable carriage supporting a print cartridge having a print head with nozzles in a nozzle face for printing ink droplets ejecting from said nozzles onto a recording medium at a printing zone in the printer, the translatable carriage being controlled by drive members under the control of a printer controller, the maintenance station being positioned at one side of the printing zone for translation of a print cartridge thereto on the translatable carriage for capping by the cap carriage, the cap carriage including a movable base for intercepting the translatable carriage when the translatable carriage enters the maintenance station, a pair of movable caps for sealing the nozzles in the printhead nozzle face, and a cam-actuated lever for moving the cap into a position in which the cap seals against the printhead nozzle face.

14 Claims, 10 Drawing Sheets

CAM-ACTUATED LEVER CAPPING ARM

BACKGROUND OF THE INVENTION

1. Field of Invention

This invention relates to maintenance stations for ink jet printing apparatus.

2. Description of Related Art

Ink jet printers have at least one printhead that directs droplets of ink towards a recording medium. Within the printhead, the ink may be contained in a plurality of channels. Energy pulses are used to expel the droplets of ink, as required, from orifices at the ends of the channels.

In a thermal ink jet printer, the energy pulses are usually produced by resistors. Each resistor is located in a respective one of the channels, and is individually addressable by current pulses to heat and vaporize ink in the channels. As a vapor bubble grows in any one of the channels, ink bulges from the channel orifice until the current pulse has ceased and the bubble begins to collapse. At that stage, the ink within the channel retracts and separates from the bulging ink to form a droplet moving in a direction away from the channel and towards the recording medium. The channel is then re-filled by capillary action, which in turn draws ink from a supply container. Operation of a thermal ink jet printer is described in, for example, U.S. Pat. No. 4,849,774.

A carriage-type thermal ink jet printer is described in U.S. Pat. No. 4,638,337.

That printer has a plurality of printheads, each with its own ink tank cartridge, mounted on a reciprocating carriage. The channel orifices in each printhead are aligned perpendicular to the line of movement of the carriage. A swath of information is printed on the stationary recording medium as the carriage is moved in one direction. The recording medium is then stepped, perpendicular to the line of carriage movement, by a distance equal to the width of the printed swath. The carriage is then moved in the reverse direction to print another swath of information.

The ink ejecting orifices of an ink jet printer need to be maintained, for example, by periodically cleaning the orifices when the printer is in use, and/or by capping the printhead when the printer is out of use or is idle for extended periods. Capping the printhead is intended to prevent the ink in the printhead from drying out. The cap provides a controlled environment to prevent ink exposed in the nozzles from drying out.

A printhead may also need to be primed before initial use, to ensure that the printhead channels are completely filled with the ink and contain no contaminants or air bubbles. After significant amounts of printing, and at the discretion of the user, an additional but reduced volume prime may be needed to clear particles or air bubbles which cause visual print defects. Maintenance and/or priming stations for the printheads of various types of ink jet printers are described in, for example, U.S. Pat. Nos. 4,364,065; 4,855,764; 4,853,717 and 4,746,938, while the removal of gas from the ink reservoir of a printhead during printing is described in U.S. Pat. No. 4,679,059.

The priming operation, which usually involves either forcing or drawing ink through the printhead, can leave drops of ink on the face of the printhead. As a result, ink residue builds up on the printhead face. This ink residue can have a deleterious effect on the print quality. Paper fibers and other foreign material can also collect on the printhead face while printing is in progress. Like the ink residue, this foreign material can also have deleterious effects on print quality.

The 717 patent discloses moving a printhead across a wiper blade at the end of a printing operation so that dust and other contaminants are scraped off the orifice before the printhead is capped, and capping the printhead nozzle by moving the printer carriage acting on a sled carrying the printhead cap. This eliminates the need for a separate actuating device for the cap. The 938 patent discloses providing an ink jet printer with a washing unit which, at the end of the printing operation, directs water at the face of the printhead to clean the printhead before it is capped.

SUMMARY OF THE INVENTION

This invention provides a cam-activated lever capping arm, for a maintenance station for an ink jet printhead, that carries and actuates one or more printhead caps movably mounted on a cap carriage to cap the printhead nozzles.

In one exemplary embodiment of the maintenance station according to this invention, one or more printheads are mounted on a translatable carriage and moves with the carriage. When the printer is printing, the translatable carriage is located in a printing zone, where the one or more printheads can eject ink onto a recording medium. When the printer is placed into a non-printing mode, the translatable carriage is translated to the maintenance station located outside and to one side of the printing zone. Once the cartridge is translated to the maintenance station, various maintenance functions can be performed on the one or more printheads of the printer depending on the rotational position of a cam shaft in the maintenance station. The cam shaft engages and drives the hardware that in turn operates the individual maintenance functions.

Rotating the cam shaft activates various maintenance mechanisms of the maintenance station, including a wiper blade platform and a cap carriage. The wiper platform passes across the printhead nozzle faces when the one or more printheads enter the maintenance station and again just before the one or more printheads leave. A location for collecting ink cleared from the nozzles is placed adjacent to the wiper blades. After the one or more printheads arrive at the maintenance station, a vacuum pump is energized, and the cap carriage is elevated to the position where the one or more printhead caps engage the one or more printheads. The one or more printhead caps are mounted on the cap carriage in a capping location. The printheads are primed when a pinch tube mechanism opens one or more pinch tubes connected to the one or more printhead caps. Opening the pinch tubes releases negative pressure created by the vacuum pump. In response, ink is drawn from the one or more printheads into the one or more printhead caps.

Further moving the cam shaft lowers the cap carriage and enables the wiper blades to pass back across the nozzle face to clean the ink jet printhead nozzles. The vacuum pump is then deenergized, while the cap carriage remains in position so that the one or more printhead caps cap the one or more printheads awaiting the printing mode of the printer. Thus, the one or more printheads remain capped at the maintenance station until the printer is into the printing mode.

The predetermined time that the printhead carriage is positioned adjacent to the maintenance station, including the gear and cam-actuated valve closing and the predetermined time that the printhead carriage is located relative to the capping platform, as controlled by the controller, determines pressure profiles and waste ink volumes. The controller enables a spectrum of waste ink volume and pressure profiles. One waste ink volume and pressure profile is appropriate for the initial installation of the cartridge, when the one or more capped printheads are kept a longer time at the capping location, to help ensure that all ink flow paths between the nozzles and supply cartridge are completely primed. A second waste ink volume and pressure profile is appropriate for a manual refresh prime. During such a manual refresh prime, the one or more capped printheads are kept at the capping location a relatively shorter time to prime only the one or more printheads.

These and other features and advantages of this invention are described in or are apparent from the detailed description of various exemplary embodiments of the systems and methods according to this invention.

BRIEF DESCRIPTION OF THE DRAWINGS

Various exemplary embodiments of this invention will be described in detail with reference to the following figures, wherein like numerals represent like elements, and wherein.

DETAILED DESCRIPTION OF EXEMPLARY EMBODIMENTS

Figure 1:
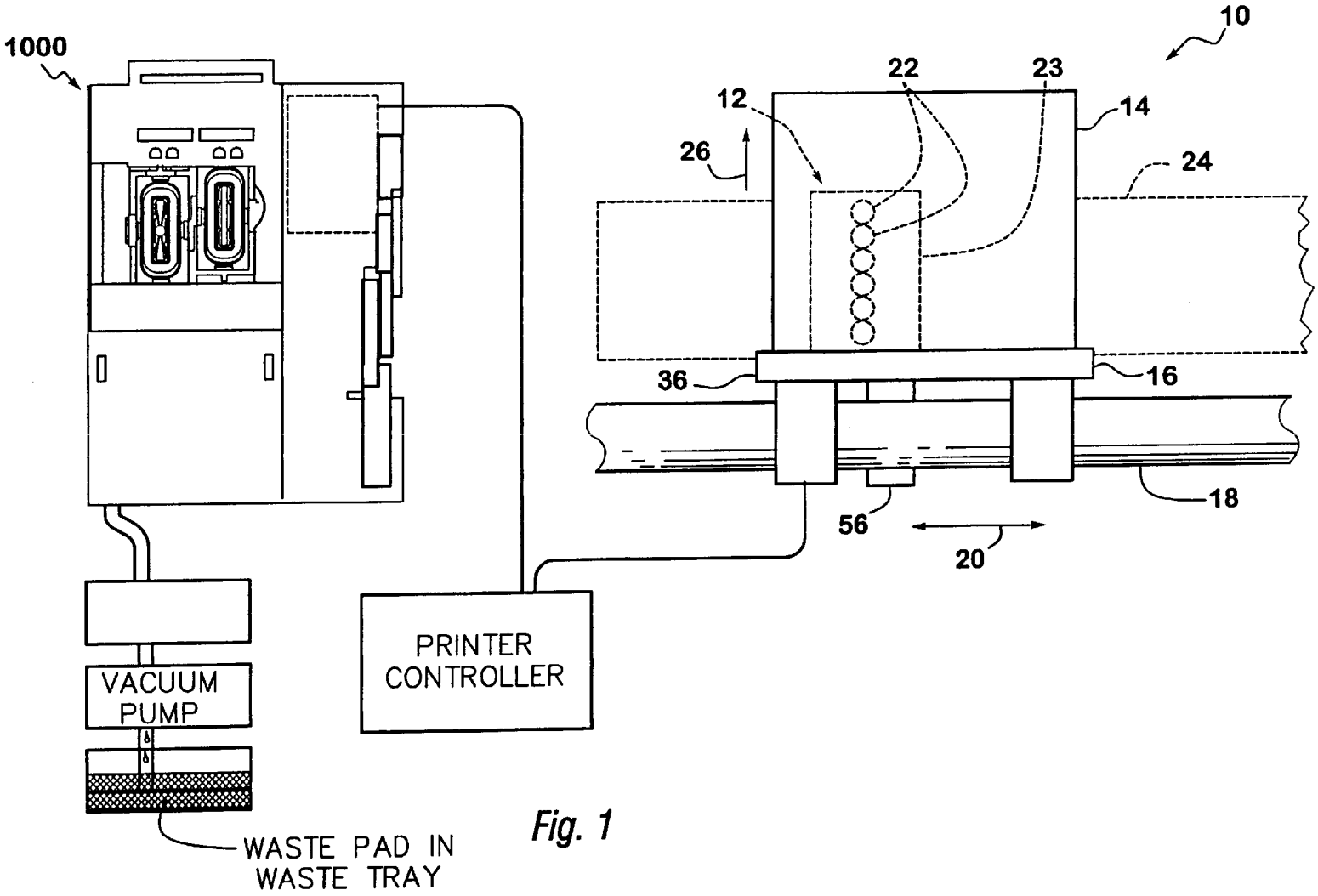
FIG. 1 is a schematic front elevation view of an ink jet printer and a maintenance station according to this invention.

FIG. 1 shows a printer 10, including one or more printheads 12, shown in dashed line, fixed to an ink supply cartridge 14. The ink supply cartridge 14 is removably mounted on a carriage 16. The carriage 16 is translatable back and forth on one or more guide rails 18 as indicated by arrow 20, so that the one or more printheads 12 and the ink supply cartridge 14 move concurrently with the carriage 16. Each of the one or more printheads 12 contains a plurality of ink channels which terminate in nozzles 22 in a nozzle face 23 (both shown in dashed line). The ink channels carry ink from the ink supply cartridge 14 to the printhead nozzles 22.

When the printer 10 is in a printing mode, the carriage 16 translates or reciprocates back and forth across and parallel to a printing zone 24 (shown in dashed line). Ink droplets are selectively ejected on demand from the printhead nozzles 22 onto a recording medium, such as paper, positioned in the printing zone, to print information on the recording medium one swath or portion at a time. During each pass or translation in one direction of the carriage 16, the recording medium is stationary. At the end of each pass, the recording medium is stepped in the direction of arrow 26 for the distance or the height of one printed swath. U.S. Pat. No. 4,571,599 and U.S. Pat. No. Re. 32,572, each incorporated herein by reference in its entirety, provide a more detailed explanation of the printhead and the printing operation.

When the printer 10 is no longer in a printing mode, the carriage 16 travels to a maintenance station 1000 spaced from the printing zone 24. With the one or more printheads 12 positioned at the maintenance station 1000, various maintenance functions can be performed on the one or more printheads 12.

Figure 2:
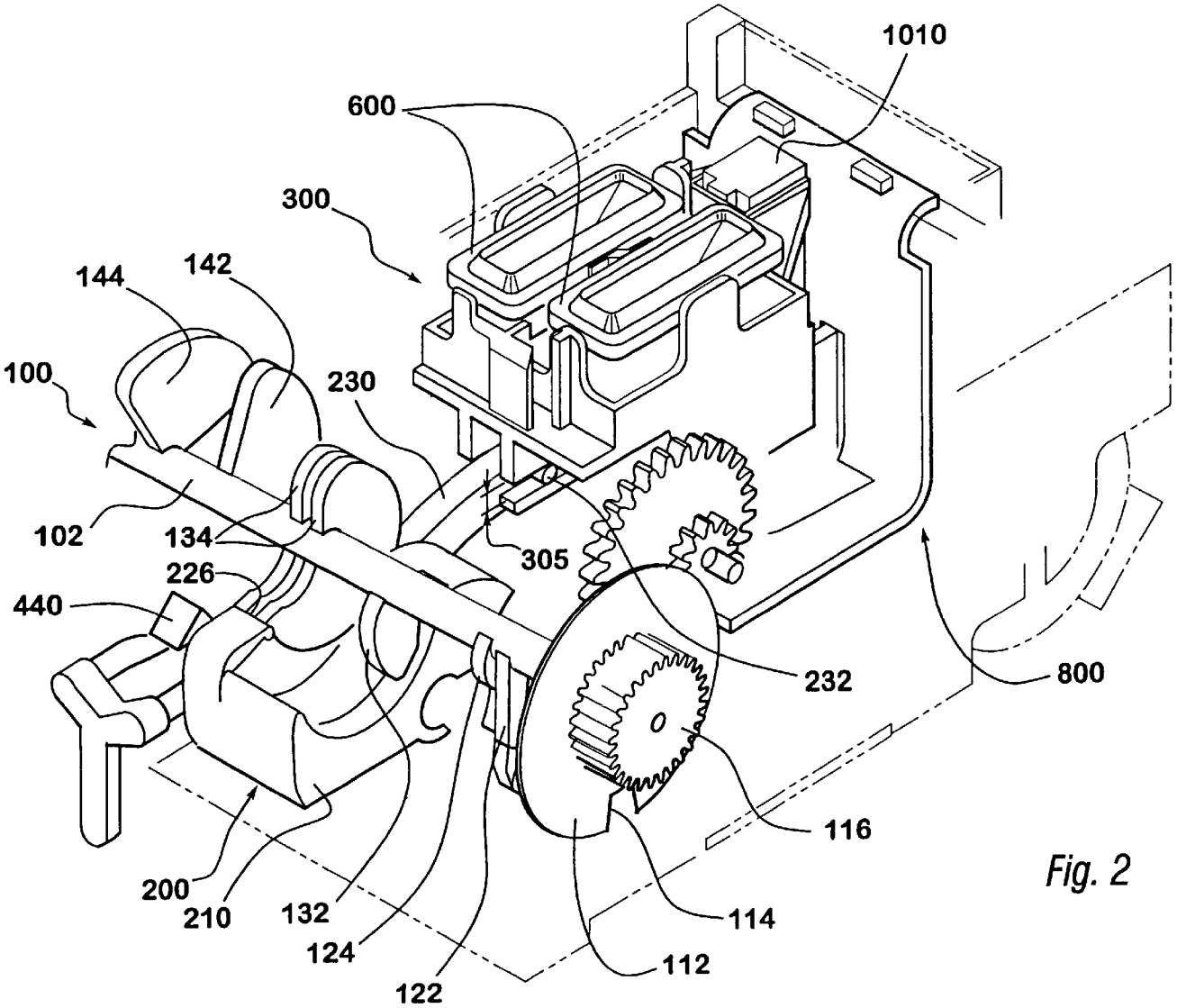
FIG. 2 is a top perspective view of the interior of a maintenance station of FIG. 1 according to this invention.

FIG. 2 is a top perspective view of the maintenance station 1000. As shown in FIG. 2, the maintenance station 1000 includes a cam shaft 100, a cam-actuated lever capping arm 200, and a cap carriage 300 mounted on a guide shaft 1010. In particular, as shown in FIG. 2, and more clearly seen in FIG. 3, the cam shaft 100 includes a driving and control portion 110, a wiper blade drive portion 120, a cam-actuated lever capping arm drive portion 130 and a pinch tube actuating portion 140.

Figure 3:
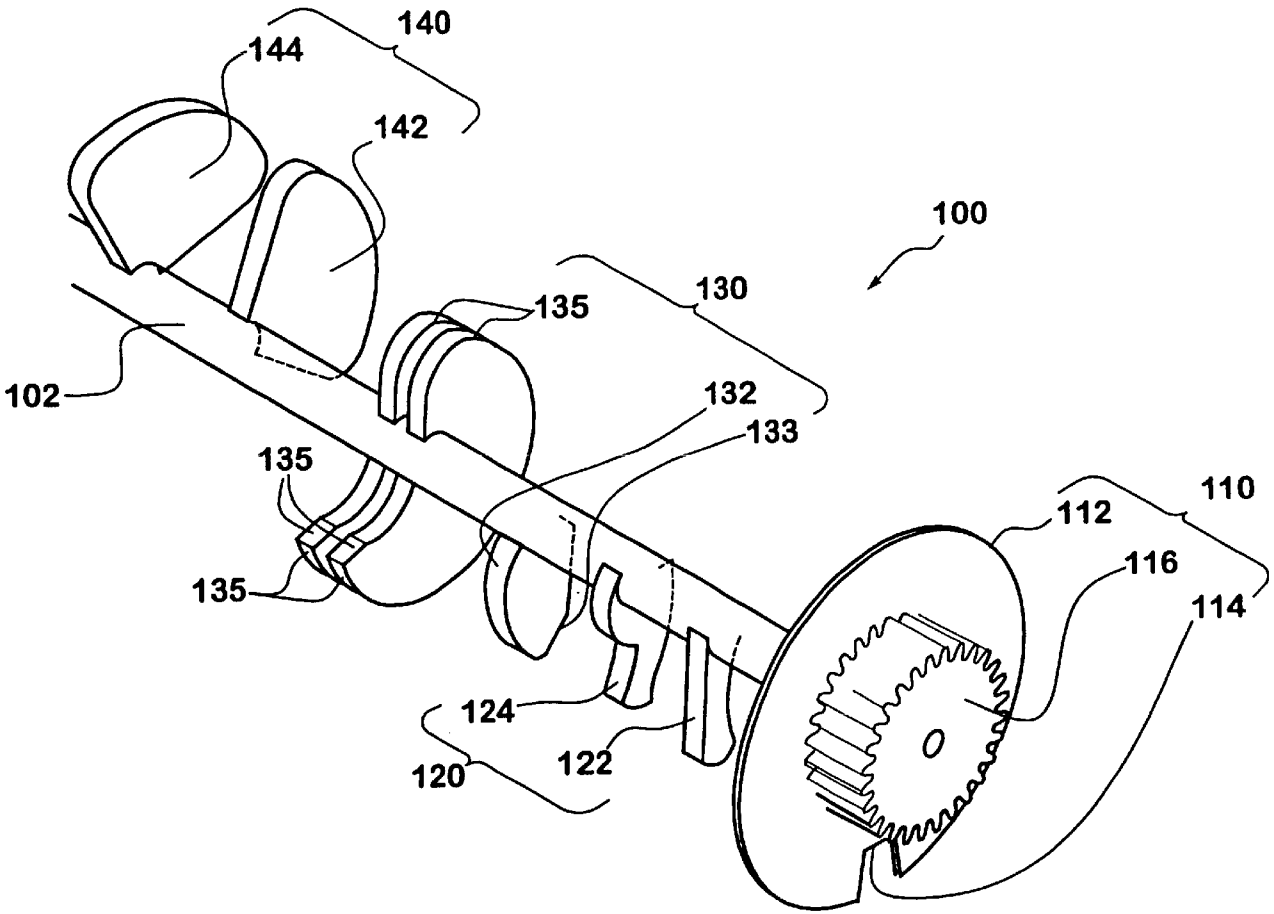
FIG. 3 is a partial perspective view of the cam shaft of FIG. 2.

In various exemplary embodiments, as shown in FIGS. 2 and 3, the driving and control portion 110 includes a sensor wheel 112, an optical window 114 formed in the sensor wheel 112, and a main drive gear 116. In operation, a drive gear train (not shown), comprising a drive motor connected to one or more drive gears, engages the main drive gear 116 to drive the cam shaft 100 in counterclockwise and then clockwise directions to actuate the various maintenance functions enabled by the maintenance station 1000. This is described in greater detail in copending U.S. patent application Ser. No. 09/594,694 filed herewith and incorporated herein by reference in its entirety.

In each of an extreme clockwise position of the cam shaft 100 and the extreme counterclockwise position of the cam shaft 100, the optical window 114 is aligned with an optical relay (not shown). Thus, after the drive gear train drives the main drive gear 116 to rotate the cam shaft 100 to the extreme clockwise or counterclockwise position, the optical window 114 formed in the sensor wheel 112 is aligned with the optical relay. In various exemplary embodiments, the optical relay includes a photo-emitter positioned on one side of the sensor wheel 112 and a photo-detector positioned on the other side of the sensor wheel 112. When the optical window 114 is not aligned with the optical relay, the optical relay is in an opened circuit condition.

At the start of a maintenance operation, the sensor wheel 112 is in the extreme clockwise position and the optical window 114 is aligned with the optical relay to close the circuit through the optical relay. As a result, when the one or more printheads 12 are aligned with the maintenance station 1000 and the main drive gear 116 is initially driven in the counterclockwise direction, the optical window 114 is no longer aligned with the optical relay and the optical relay is placed into an open circuit condition. Then, when the sensor wheel 112 reaches its extreme counterclockwise position, the window 114 is again aligned with the optical relay. As a result, the optical relay is placed in the closed circuit condition.

The open and closed circuit conditions of the optical relay are sensed by a controller (not shown). In response, the controller stops the gear train engaged with the main drive gear 116 from turning the cam shaft 100 for a predetermined time. In particular, this predetermined time depends on the priming mode currently selected for the maintenance station 1000.

Once the predetermined time has elapsed, the controller starts the gear train to drive the main drive gear 116, and thus the cam shaft 100, in the clockwise direction. The cam shaft 100 continues rotating in the clockwise direction until the optical window 114 in the sensor wheel 112 is again aligned with the optical relay to again put the optical relay in a closed circuit condition. When the controller again senses the closed circuit condition of the optical relay, the controller again stops the gear train from driving the main drive gear 116, and thus the cam shaft 100, in the clockwise direction.

In particular, in various exemplary embodiments, when the cam shaft 100 first begins rotating in the counterclockwise direction, the wiper blade portion 120 drives a wiper blade platform (not shown) from a first position to a second position to wipe the nozzle faces 23 of the one or more printheads 12. Then, when the cam shaft 100 is driven in the clockwise direction, the wiper blade drive portion 120 of the cam shaft 100 lastly drives the wiper blade platform from the second position back to the first position to wipe the nozzle face 23 of the one or more printheads 12 before the printhead 14 is moved from the maintenance station 1000 to the printing zone 24. The wiper blade platform, a wiper blade drive mechanism positioned between the cam shaft 100 and the wiper blade platform, and the operation of the wiper blade drive portion 120 is described in greater detail in the incorporated U.S. patent application Ser. No. 09/594,694 application.

In various exemplary embodiments, after the wiper blade drive portion 120 moves the wiper blade platform from the first position to the second position, the cam shaft 100 rotates further in the counterclockwise direction. As a result, the cam-actuated lever capping arm drive portion 130 interacts with a cam-actuated lever arm 200 to move a cap carriage 300 from a disengaged position to an engaged position. In the engaged position, one or more printhead caps 600 carried by the cap carriage 300 engage the one or more printheads 12 as the cam shaft 100 continues to rotate in the counterclockwise direction. Similarly, when the cam shaft 100 is driven in the clockwise direction, the cam-actuated lever capping arm drive portion 130 interacts with the cam-actuated lever arm 200 to move the capping carriage 300 from the engaged position to the disengaged position, before the wiper blade drive portion 120 moves the wiper blade platform from the second position back to the first position. This is described in greater detail below. The structure and operation of the printhead caps 600 are described in greater detail in copending U.S. patent application Ser. No. 09/594,682 and Ser. No. 09/594,690 each filed herewith and incorporated herein by reference in their entirety.

Likewise, after the cam-actuated lever capping arm drive portion 130 moves the capping station 300 from the disengaged position to the engaged position, the cam shaft 100 rotates further in the counterclockwise direction. As a result, the pinch tube actuating portion 140 actuates one or more pinch tubes (not shown) to apply a negative pressure to the one or more printheads cap 600 mounted on the cap carriage 300. The structure and operation of the pinch tubes and pinch mechanism is described in greater detail in copending U.S. patent application Ser. No. 09/594,680 filed herewith and incorporated herein by reference in its entirety. The cam shaft 100 then continues to rotate in the counterclockwise direction until the cam shaft 100 reaches the extreme counterclockwise position. The controller, based on the signal from the optical relay generated when the optical window 114 is aligned with the optical relay, maintains the cam shaft 100 in the extreme counterclockwise position for one of the predetermined times.

Then, after the predetermined time has elapsed, the controller engages the drive motor of the drive gear train to rotate the cam shaft 100 in the clockwise direction. When the cam shaft 100 is rotated in the clockwise direction, the pinch tube actuation portion 140 again interacts with the one or more pinch tubes before the cap carriage 300 is moved from the engaged position to the disengaged position by the cam-actuated lever capping arm drive portion 130, which occurs before the wiper blade drive portion 120 moves the wiper blade platform from the second position to the first position.

As shown in FIGS. 2 and 3, the various elements of the cam shaft drive portion 110, the wiper blade drive portion 122, the cam-actuated lever capping arm drive portion 130 and the pinch tube actuation portion 140 are mounted on a shaft 102 of the cam shaft 100. As shown in FIGS. 2 and 3, in various exemplary embodiments, the wiper blade drive portion 120 includes a forward wiper driving cam 122 that is used to drive the wiper blade platform from the first position to the second position, and a reverse wiper blade driving cam 124 that is used to drive the wiper blade platform from the second position back to the first position.

In the exemplary embodiments shown in FIGS. 2–10, the cam-actuated lever capping arm drive portion 130 includes a hold-down cam 132 and one or more capping cams 134. In particular, in the exemplary embodiments shown in FIGS. 2–10, the one or more capping cams 134 are provided as a dual capping cam. This dual capping cam allows the force or load between the capping cams 134 and the cam-actuated lever capping arm 200 to be distributed between the two capping cams 134 to reduce wear between the capping cams 134 and the cam-actuated lever capping arm 200. In various exemplary embodiments of the cam-actuated lever capping arm drive portion 130, the hold-down cam 132 has an outer surface 133 that engages the cam-actuated lever capping arm 200. Similarly, each of the one or more capping cams 134 has a curved surface 135 that also engages the cam-actuated lever capping arm 200.

In the exemplary embodiments shown in FIGS. 2 and 3, the cap carriage 300 carries two printhead caps 600, each having a separate pinch tube. Accordingly, the pinch tube actuation portion 140 includes a first pinch tube actuating cam 142 and a second pinch tube actuation cam 144. The first pinch tube actuating cam 142 actuates a first pinch mechanism to pinch a first tube connected to the first one of the two printhead caps 600. Similarly, the second pinch tube actuating cam 144 actuates a second pinch mechanism to pinch a second tube connected to the second one of the two printhead caps 600.

Figure 4:
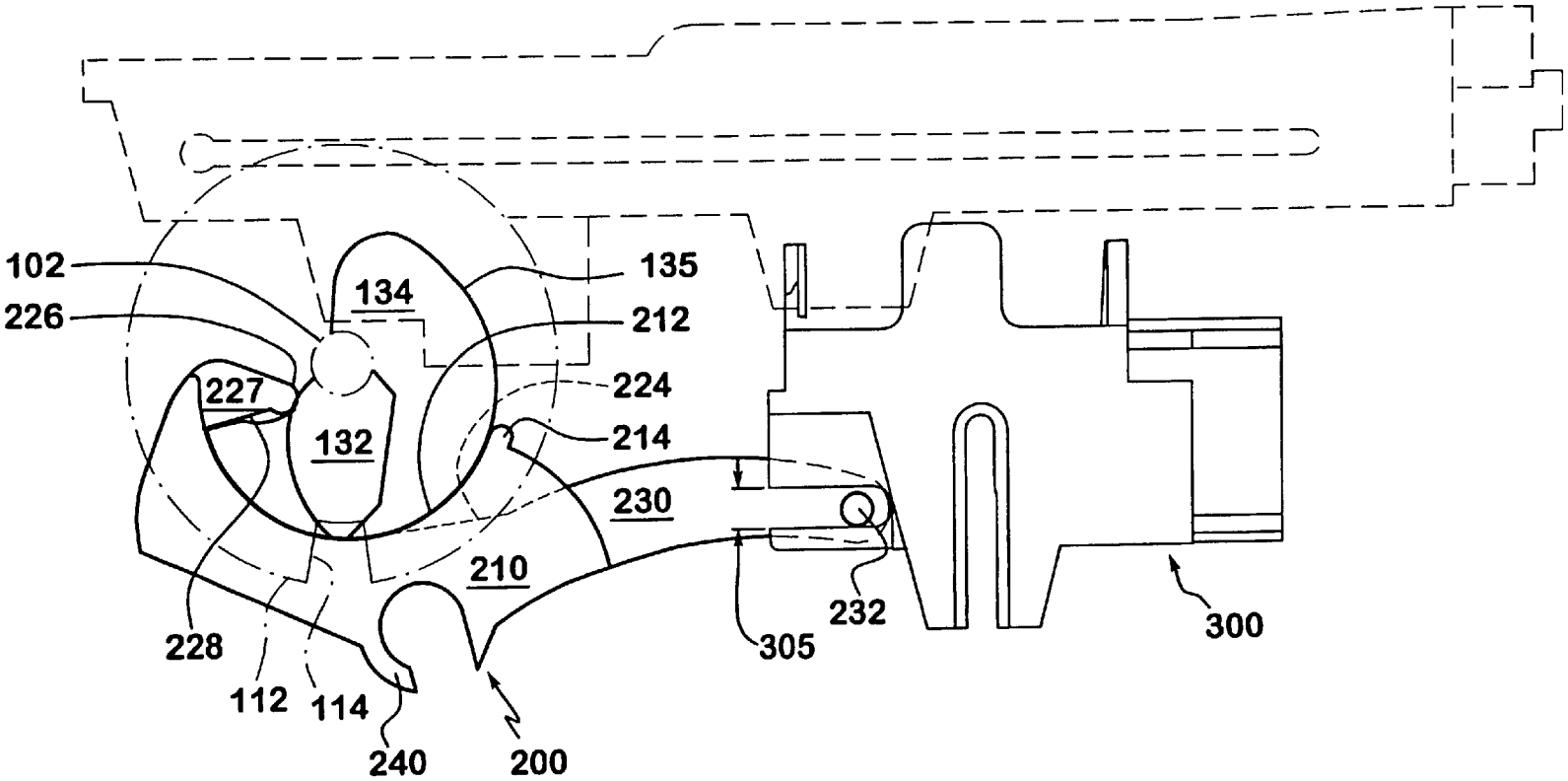
FIG. 4 is a side plan view of one exemplary embodiment of a cam-actuated lever capping arm according to this invention, in an extreme clockwise position.
Figure 5:
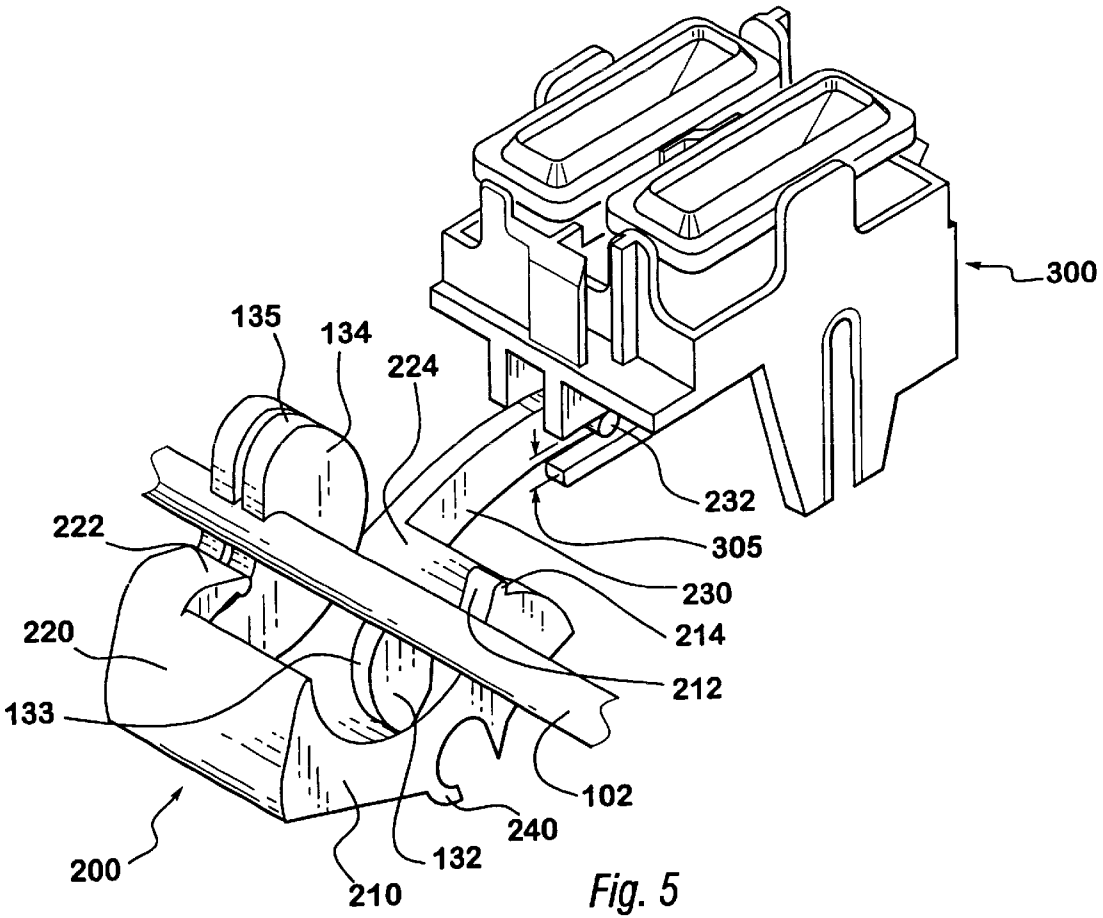
FIG. 5 is a front perspective view of the cam-actuated lever capping arm with the cam in the extreme clockwise position.

FIGS. 4 and 5 show a side plan and a front perspective view, respectively, of the cam-actuated lever capping arm 200, with the cam shaft 100 in the extreme clockwise position. When the cam shaft 100 is in the extreme clockwise position, the cam-actuated lever capping arm 200 is fully "lowered" to place the cap carriage 300 in the disengaged position. As indicated above, when the cap carriage 300 is in the disengaged position and the cam shaft 100 is in the extreme clockwise position, the optical window 114 of the sensor wheel 112 is aligned with the optical relay. When the optical relay is in the closed circuit position and the printhead is moved into the maintenance station 1000, the controller drives the gear train to drive the gear train 100 in the counterclockwise direction.

As shown in FIGS. 4 and 5, the cam-actuated lever capping arm 200 includes a hold-down cam engaging portion 210, a capping cam engaging portion 220, a lever arm portion 230, and a mounting portion 240. The mounting portion 240 rotatably mounts the cam-actuated lever capping arm 200 on a fixed shaft (not shown) of the maintenance station 1000. The mounting portion 240 "snap-fits" over the fixed shaft. In particular, the hold-down cam engaging portion 210 engages the hold-down cam 132 to rotate the cam-actuated lever capping arm 200 in a clockwise direction about the fixed shaft to move the cap carriage 300 from the engaged position to the disengaged position. In contrast, the capping cam engaging portion 220 engages the one or more capping cams 134 to rotate the cam-actuated lever capping arm 200 about the fixed shaft in a counterclockwise direction to raise the cap carriage 300 from the disengaged position to the engaged position.

In various exemplary embodiments, the hold-down cam engaging portion 210 includes a inverted cam surface 212, and a protruding follower portion 214. When the cam shaft 100 rotates in the clockwise direction, the down cam surface 133 of the hold-down cam 132 engages the inverted cam surface 212. The hold-down cam portion 210 of the cam-actuated lever capping arm 200 that contacts the hold-down cam 132 terminates at the protruding portion 214. The hold-down cam 132 contacts the protruding portion 214 when the cam shaft 100 rotates in the counterclockwise direction.

In various exemplary embodiments, the capping cam engaging portion 220 includes a cap cam follower 222, a curvilinear surface 224, a protruding leading portion 226, a capping cam stop 227 and an inner surface 228. When the cam shaft 100 rotates in the clockwise and the counterclockwise direction, the one or more capping cams interact with various elements of the capping cam engaging portion 220. Before the cam shaft 100 begins to turn counterclockwise from its extreme clockwise position, each at least one capping cam 134 is resiliently engaged against the capping cam stop 227 formed in the curvilinear surface 224 of the capping cam engaging portion 220 of the cam-actuated lever capping arm 200.

In various exemplary embodiments, the lever arm portion 230 of the cam-actuated lever capping arm 200 has a pair of pins 232 that extend laterally from the lever arm portion 230 and fit into a slot 305 in the cap carriage 300. The lever arm 230 and the pins 232 engage a top surface of the slot 305 when the cam-actuated capping arm 200 is driven in the counterclockwise direction to raise the cap carriage 300 from the disengaged position to the engaged position. In contrast, the pins 232 of the lever arm 230 of the cam-actuated lever capping arm 200 engage a bottom surface of the slot 305 when the cam-actuated lever capping arm 200 is driven in the clockwise direction to move the cap carriage 300 from the engaged position to the disengaged position.

Figure 6:
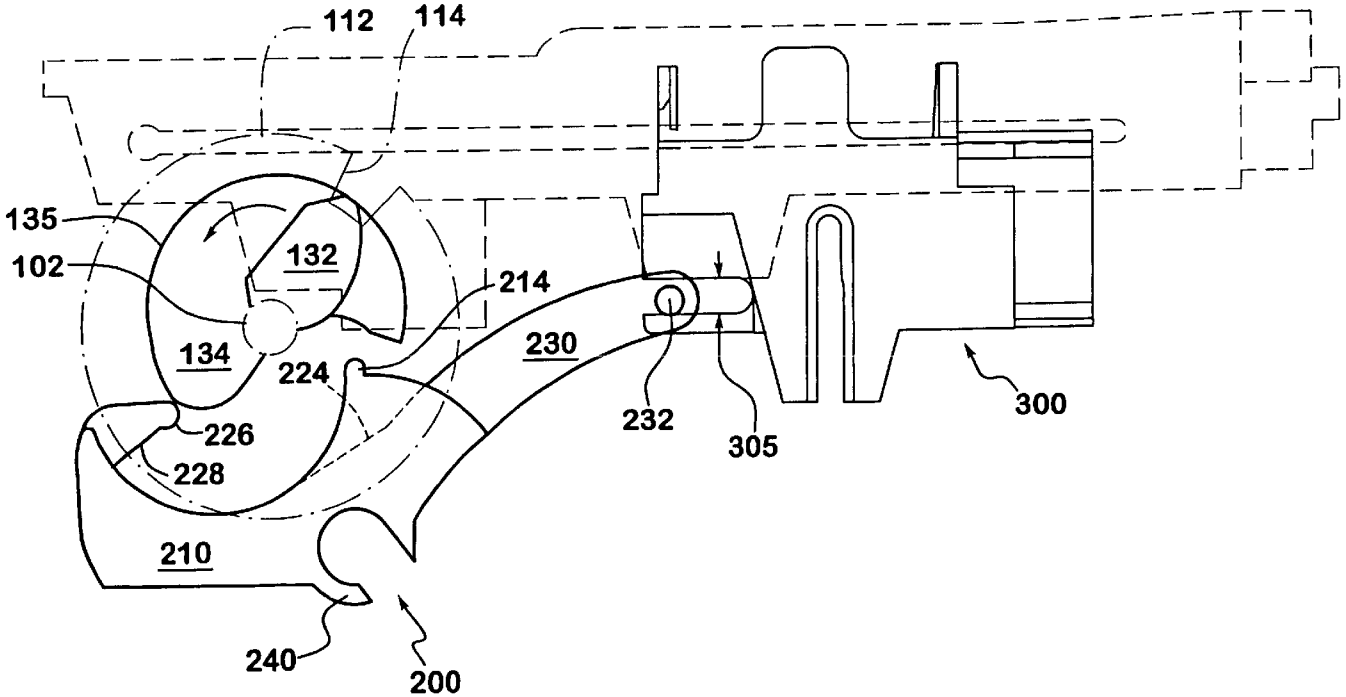
FIG. 6 is a side plan view of the cam-actuated lever capping arm with the cam shaft advanced counterclockwise.

FIG. 6 is a side plan view of the cam-actuated lever capping arm 200 with the cam shaft 100 advanced in a counterclockwise position away from the extreme clockwise position of the cam shaft 100 shown in FIG. 4. The surface 135 of each of the one or more capping cams 134 separates from the inner surface 228 of the cam stop 227 of the capping arm engaging portion 220 of the cam-actuated lever capping arm 200. In response, the pins 232 of the lever 230 of the cam-actuated capping arm 200 bear against the top surface of the slot 305 to move the cap carriage 300 from the disengaged position to the engaged position to engage the nozzle surfaces 23 of the one or more printheads 12. The motion of the cap carriage 300 is driven by the counterclockwise rotation of the cam shaft 100. Specifically, the one or more capping cams 134 resiliently contact the protruding leading portion 226 of the capping cam stop 227. In response, the capping cam portion 200 acts as a cam follower. The force exerted on the protruding leading portion 226 of the capping cam engaging portion 220 forces the cam-actuated lever capping arm 200 to rotate down or counterclockwise about the fixed shaft. This motion is transferred to the cap carriage 300 by the lever arm portion 230. This transferred motion in turn moves the cap carriage 300 from the disengaged position to the engaged position.

Figure 7:
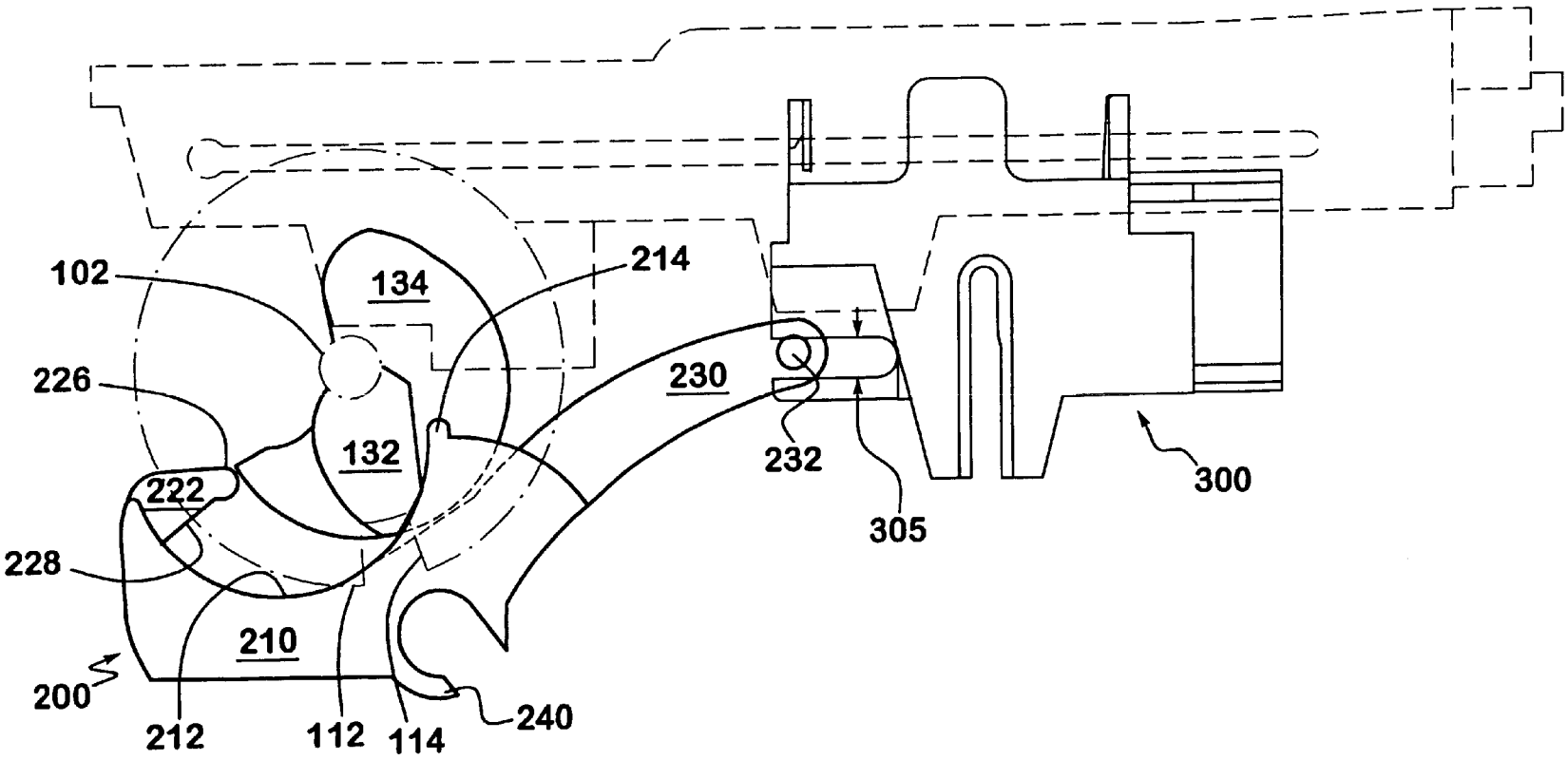
FIG. 7 is a side plan view of the cam-actuated lever capping arm with the cam shaft in an extreme counterclockwise position.
Figure 8:
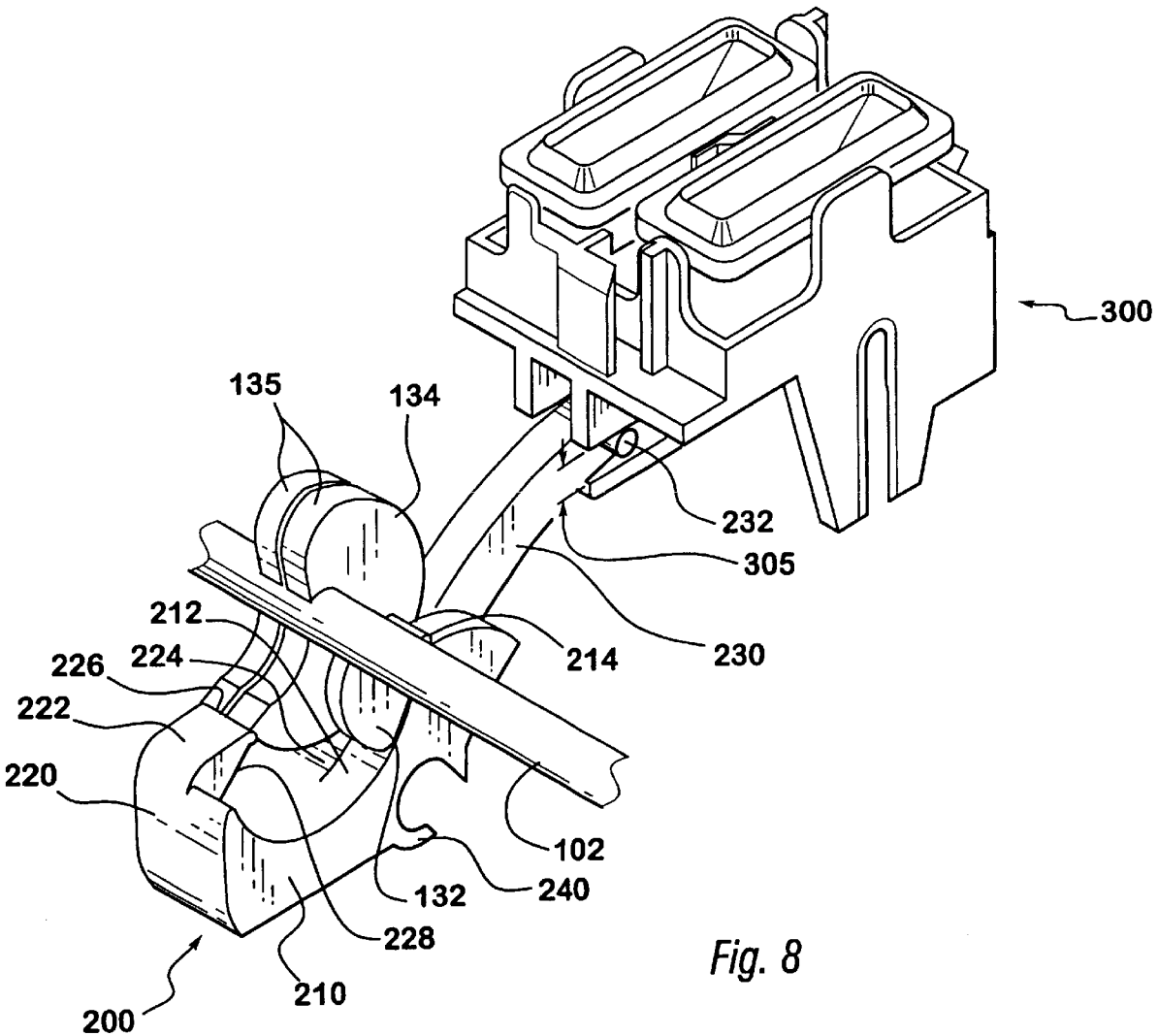
FIG. 8 is a front perspective view of the can-actuated lever capping arm with the camshaft in the extreme counterclockwise position.

FIG. 7 and FIG. 8 show a plan view and a perspective view of the cam-actuated lever capping arm 200, respectively, with the cam shaft 100 in the extreme counterclockwise position, and the cam activated lever capping arm 200 in the fully raised position and the cap carriage 300 in the engaged position. After the cam shaft 100 has rotated in a counterclockwise position, and the cam stop surface 133 of the hold-down cam 132 resiliently contacts the surface 212 of the hold-down cam engaging portion 210 of the cam-actuated lever capping arm 200, the optical window 114 is aligned with the optical relay. As a result, the optical relay is placed into the closed circuit condition. The controller, in response, holds the cap carriage in the engaged position for the predetermined time, then reverses the drive direction of the gear train, which in response, rotates the cam shaft 100 in a clockwise direction.

Figure 9:
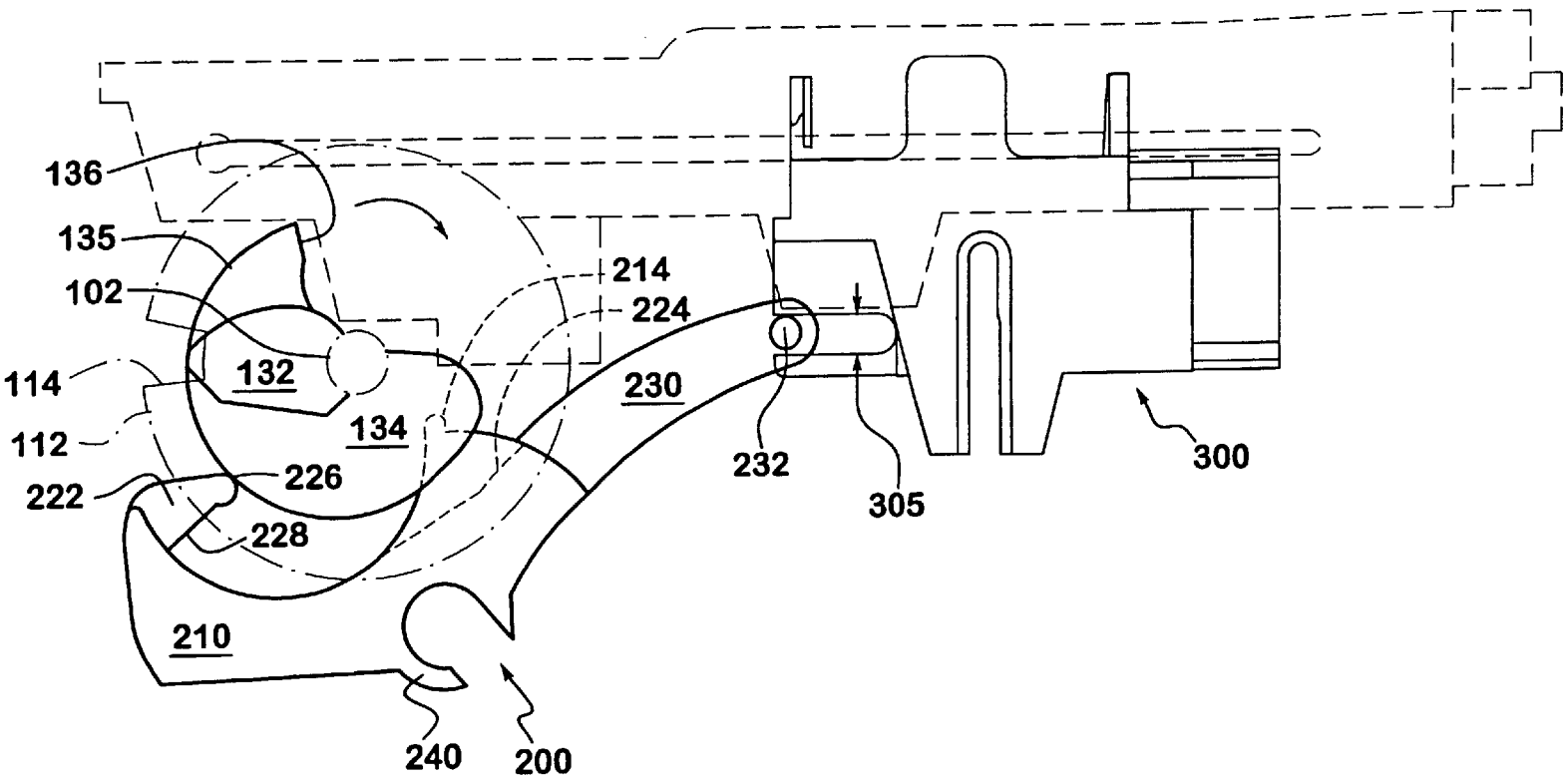
FIG. 9 is a side plan view of the cam-actuated lever capping arm with the cam shaft advanced in a clockwise position away from the extreme counterclockwise position of FIGS. 7 and 8.

FIG. 9 shows the cam shaft 100 advanced to a clockwise position away from the extreme counterclockwise position shown in FIGS. 7 and 8. As the cam shaft 100 continues to rotate in a clockwise position, an edge 136 of each of the one or more capping cams 134 will engagably contact the curvilinear surface 224 of the capping cam engaging portion 220 of the cam-actuated lever capping arm 200. As the cam shaft 100 continues to turn the one or more capping cams 134 in a clockwise direction, the leading edge 136 of each of the one or more capping cams 134 will engage the curvilinear surface 224 to push the cam-actuated lever capping arm 200 gradually in a clockwise direction about the fixed shaft. This motion is transferred to the cap carriage 300 by the lever arm portion 230. This transferred motion moves the cap carriage 300 from the engaged position to the disengaged position.

Figure 10:
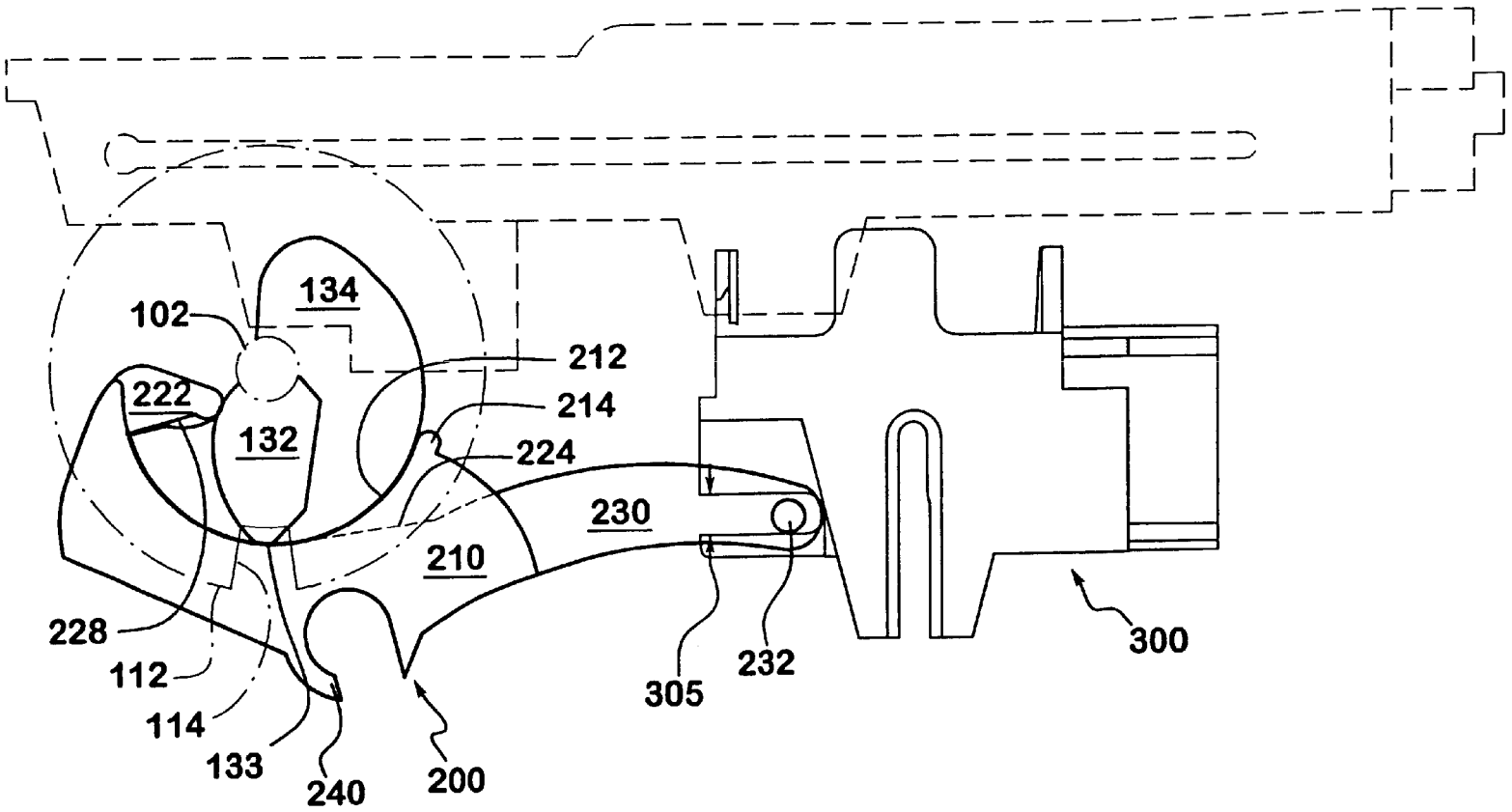
FIG. 10 is a side plan view of the cam-actuated lever capping arm with the cam shaft further advanced in a clockwise position relative to FIG. 9.

FIG. 10 shows the cam shaft 100 further advanced in the clockwise position away from the position shown in FIG. 9. In particular, FIG. 10 shows the cam-actuated lever capping arm 200 returned to the extreme clockwise position. As the cam shaft 100 continues in the clockwise direction from the position shown in FIG. 9 to the position shown in FIG. 10, the hold-down cam 132 bears against the protruding portion 214 of the hold-down engaging portion 210 and the leading edge 136 of each of the one or more capping cams 134 continues to bear against the curvilinear surface 224 of the capping cam portion 220 of the cam-actuated lever capping arm 200. This causes the cam-actuated lever capping arm 200 to rotate clockwise about the fixed shaft. The cam-actuated lever capping arm continues to rotate clockwise about the fixed shaft until the surface 135 resiliently contacts the cam stop 227. When the surface 135 of each of the capping cams 134 has resiliently contacted the cam stop 227, the cam-actuated lever capping arm 200 has moved the cap carriage 300 from the engaged position to the disengaged position.

In one exemplary embodiment, many individual systems cooperate to maintain and maximize the useful life of the one or more printheads 12, and may, for example, take place at a maintenance station. The maintenance station 1000, may be, for example, at one side of the printer, outside the printing zone 24. At the end of a printing operation or termination of the printing mode by the printer 10, the carriage 16 is moved to the maintenance station 1000. With the one or more printhead nozzle faces 23 positioned adjacent to the maintenance station, the controller activates the maintenance station motor to drive the maintenance station gear train and as described above activates the wiper blade platform to wipe ink and debris from the printhead nozzle faces 23 every time the one or more printheads 12 enter or exit the maintenance station 1000.

The maintenance station gear train advances the cam shaft 100, which actuates the one or more capping cams 134, which in turn actuate the cam-actuated lever capping arm 200. The lever capping arm 200 moves the cap carriage 300 into the engaged position where the caps 600 can receive and cap the one or more printheads 12.

Thus, once the one or more printhead nozzle faces 23 are capped by the one or more caps 600, the controller may optionally have the one or more printheads 12 eject a number of ink droplets into the caps 600.

While this invention has been described in conjunction with the exemplary embodiments outlined above, it is evident that many alternatives, modifications and variations will be apparent to those skilled in the art. Accordingly, the exemplary embodiments of the invention, as set forth above, are intended to be illustrative, not limiting. Various changes may be made without departing from the spirit and scope of the invention.

What is claimed is:

1. A maintenance station for an ink jet printer having at least one printhead comprising:

a rotatable cam shaft having:

a hold-down cam; and at least one capping cam;

a rotatably mounted cam-actuated lever arm mechanism, having a hold-down cam engaging portion engageable with the hold-down cam;

a capping cam engaging portion engageable with the at least one capping cam; and a lever arm portion; and a cap carriage having at least one printhead cap and a movable base wherein when the cam shaft rotates in a first direction, the cap carriage engages the cam-actuated lever arm, the lever arm portion bearing against the cap carriage to move the cap carriage from a first position where the at least one printhead cap is disengaged from the at least one printhead to a second position where the at least one printhead cap is engageable with the at least one printhead; and when the cam shaft rotates in a second direction to the first direction, the hold-down cam engages a follower and an inverted cam on the lever arm.

2. The maintenance of claim 1, wherein the cam-actuated lever arm mechanism further comprises:

at least one capping cam and a first complementary curvilinear recess within the lever for engaging and locking the cap to a translatable print cartridge; and a hold-down cam and a second complementary curvilinear recess within the lever for supporting the cap, and to prevent excessive relative movement between the carriage and each of the at least one printhead nozzle face.

3. The maintenance station of claim 1, wherein the movable base further comprises:

a platform section defining two openings;

a wall section surrounding and supported by the platform section;

at least two support members; and a rail and elongated groove having parallel sidewalls which slidably fit around the support structure of the support members.

4. A cap carriage usable in a maintenance station of an ink jet printer, having a first printhead that ejects at least one pigment-based ink and a second printhead that ejects at least one dye-based ink, the cap carriage comprising:

a movable base for intercepting a translatable carriage when the translatable carriage enters the maintenance station;

at least one movable cap for sealing the nozzles in each of the first and second printhead nozzle face, the at least one cap being pivotally mounted in at least one base walls for pivotal movement in all directions; and a rotatably mounted cam-actuated lever arm having a hold down cam engaging portion engageable with a hold down cam and a capping cam engaging portion engageable with the at least one capping cam from a position spaced from each of the first and second printhead nozzle face to a position in which the cap seals against the printhead nozzle and surrounds the nozzles therein.

5. The cap carriage of claim 4, wherein the lever further comprises:

at least one capping cam and a first complementary curvilinear recess within the lever for engaging and locking the cap to a translatable print cartridge; and a hold-down cam and a second complementary curvilinear recess within the lever for supporting the cap, and to prevent excessive relative movement between the carriage and each of the first and second printhead nozzle face.

6. The cap carriage of claim 5 , wherein the movable base further comprises:

a platform section defining two openings;

a wall section surrounding and supported by the platform section;

at least two support members; and a rail and elongated groove having parallel side walls which slidably fit around the support structure of the support members.

7. The cap carriage of claim 6, wherein the at least one movable cap further comprises:

two pairs of supporting pins extending from the outer edge of at least one movable cap; and two pairs of channels in the cap carriage wall section to accept the supporting pins, substantially surrounded by a raised section.

8. A method of operating a rotatably mounted cam-actuated lever arm mechanism usable in a maintenance station for an ink jet printer having at least one printhead comprising:

positioning a rotatable cam shaft having:

a hold-down cam; and at least one capping cam;

mounting a rotatably mounted cam-actuated lever arm mechanism, having a hold-down cam engaging portion engageable with the hold-down cam;

a capping cam engaging portion engageable with the at least one capping cam; and a lever arm portion; and engaging a cap carriage having at least one printhead cap and a movable base wherein when the cam shaft rotates in a first direction, the cap carriage engages the cam-actuated lever arm, the lever arm portion bearing against the cap carriage to move the cap carriage from a first position where the at least one printhead cap is disengaged from the at least one printhead to a second position where the at least one printhead cap is engageable with the at least one printhead; and when the cam shaft rotates in a second direction to the first direction, the hold-down cam engages a follower and an inverted cam on the lever arm.

9. The method of claim 8, wherein the mounting the cam-actuated lever arm mechanism step further comprises:

engaging at least one capping cam and a first complementary curvilinear recess within the lever for engaging and locking the cap to a translatable print cartridge; and positioning a hold-down cam and a second complementary curvilinear recess within the lever for supporting the cap, and to prevent excessive relative movement between the carriage and each of the at least one printhead nozzle face.

10. The method of claim 8, wherein the engaging a cap carriage having at least one printhead cap and a movable base step further comprises:

positioning a platform section defining two openings;

positioning a wall section surrounding and supported by the platform section;

positioning at least two support members; and positioning a rail and elongated groove having parallel sidewalls which slidably fit around the support structure of the support members.

11. A method of operating a cap carriage usable in a maintenance station of an ink jet printer, having a first printhead that ejects at least one pigment-based ink and a second printhead that ejects at least one dye-based ink, the cap carriage comprising:

positioning a movable base for intercepting a translatable carriage when the translatable carriage enters the maintenance station;

mounting at least one movable cap for sealing the nozzles in each of the first and second printhead nozzle face, the at least one cap being pivotally mounted in at least one base walls for pivotal movement in all directions; and mounting a rotatably mounted cam-actuated lever arm having a hold down cam engaging portion engageable with a hold down cam and a capping cam engaging portion engageable with at least one capping cam from a position spaced from each of the first and second printhead nozzle face to a position in which the cap seals against the printhead nozzle and surrounds the nozzles therein.

12. The method of claim 11, wherein the mounting a rotatably mounted cam-actuated lever step further comprises:

positioning at least one capping cam and a first complementary curvilinear recess within the lever for engaging and locking the cap to a translatable print cartridge; and positioning a hold-down cam and a second complementary curvilinear recess within the lever for supporting the cap, and to prevent excessive relative movement between the carriage and each of the first and second printhead nozzle face.

13. The method of claim 12, wherein the engaging a cap carriage having at least one printhead cap and a movable base step further comprises:

positioning a platform section defining two openings;

positioning a wall section surrounding and supported by the platform section;

positioning at least two support members; and positioning a rail and elongated groove having parallel side walls which slidably fit around the support structure of the support members.

14. The method of claim 13, wherein the engaging a cap carriage having at least one printhead cap and a movable base step further comprises:

placing two pairs of supporting pins extending from the outer edge of at least one movable cap; and placing two pairs of channels in the cap carriage wall section to accept the supporting pins, substantially surrounded by a raised section.

* * * * *